US010456697B2

(12) United States Patent
Tai

(10) Patent No.: US 10,456,697 B2
(45) Date of Patent: Oct. 29, 2019

(54) TOY TRACK SYSTEM

(71) Applicant: Nice Great Technology Limited, Hong Kong (CN)

(72) Inventor: Ming Kit Tai, Hong Kong (CN)

(73) Assignee: NICE GREAT TECHNOLOGY LIMITED, Kowloon (HK)

( * ) Notice: Subject to any disclaimer, the term of this patent is extended or adjusted under 35 U.S.C. 154(b) by 0 days.

(21) Appl. No.: 15/950,253

(22) Filed: Apr. 11, 2018

(65) Prior Publication Data

US 2019/0201800 A1 Jul. 4, 2019

(30) Foreign Application Priority Data

Dec. 28, 2017 (HK) ..... 17113930.7

(51) Int. Cl.
*A63H 18/02* (2006.01)
*A63H 17/26* (2006.01)

(52) U.S. Cl.
CPC ..... *A63H 18/02* (2013.01); *A63H 18/028* (2013.01)

(58) Field of Classification Search
CPC ..... A63H 17/14; A63H 17/262; A63H 18/00; A63H 18/02; A63H 18/028; A63H 18/08
USPC ..... 446/444; 104/138.1
See application file for complete search history.

(56) References Cited

U.S. PATENT DOCUMENTS 4,140,276 A * 2/1979 Halford ..... A63H 18/02 104/54
4,231,294 A * 11/1980 Arzoumanian ..... A63H 19/10 104/138.1
4,250,657 A * 2/1981 Barlow ..... A63F 9/0079 104/155
4,585,166 A * 4/1986 Stephens ..... A63H 18/02 238/10 F
4,838,170 A * 6/1989 Illakowicz ..... B61B 13/10 104/138.2
5,507,679 A * 4/1996 Getsay ..... A63H 18/00 104/119

(Continued)

FOREIGN PATENT DOCUMENTS

CN 201179344 Y 1/2009
WO WO 2017/184836 A1 10/2017

OTHER PUBLICATIONS

Hong Kong Search Report of HK priority application HK17113930.7, dated Apr. 3, 2018.

*Primary Examiner* — Alexander R Niconovich
(74) *Attorney, Agent, or Firm* — Leydig, Voit & Mayer, Ltd.

(57) ABSTRACT

A toy track system includes a tube section having first and second ends and a length extending between the first and second ends. The tube section includes first and second halves. When joined together, the first and second halves define an interior volume through which a toy car can move. A connection module has a longitudinal coupling structure extending along the length of the connection module for engaging the first end of the tube section, holding the first and second halves together and preventing separation between the first and second halves from each other, wherein the tube section includes a bend along the length of the tube section so that the first and second ends of the tube section point towards different directions and the tube section has an arched periphery.

11 Claims, 1 Drawing Sheet

(56) References Cited

U.S. PATENT DOCUMENTS

| | | | | |
|---|---|---|---|---|
| 7,618,302 | B2 * | 11/2009 | Collins | A63H 18/02 446/168 |
| 8,251,768 | B2 * | 8/2012 | Nuttall | A63H 18/028 446/153 |
| 9,421,473 | B2 * | 8/2016 | Ostendorff | A63H 18/023 |
| 2005/0266768 | A1 * | 12/2005 | Bailey | A63H 17/14 446/427 |
| 2009/0130946 | A1 * | 5/2009 | Fink | A63H 18/026 446/95 |
| 2010/0304640 | A1 * | 12/2010 | Sofman | A63H 17/40 446/456 |
| 2016/0220915 | A1 * | 8/2016 | Cheung | A63H 18/02 |
| 2018/0043273 | A1 * | 2/2018 | Farrell | A63H 17/004 |
| 2019/0201801 | A1 * | 7/2019 | Cheung | A63H 18/028 |

* cited by examiner

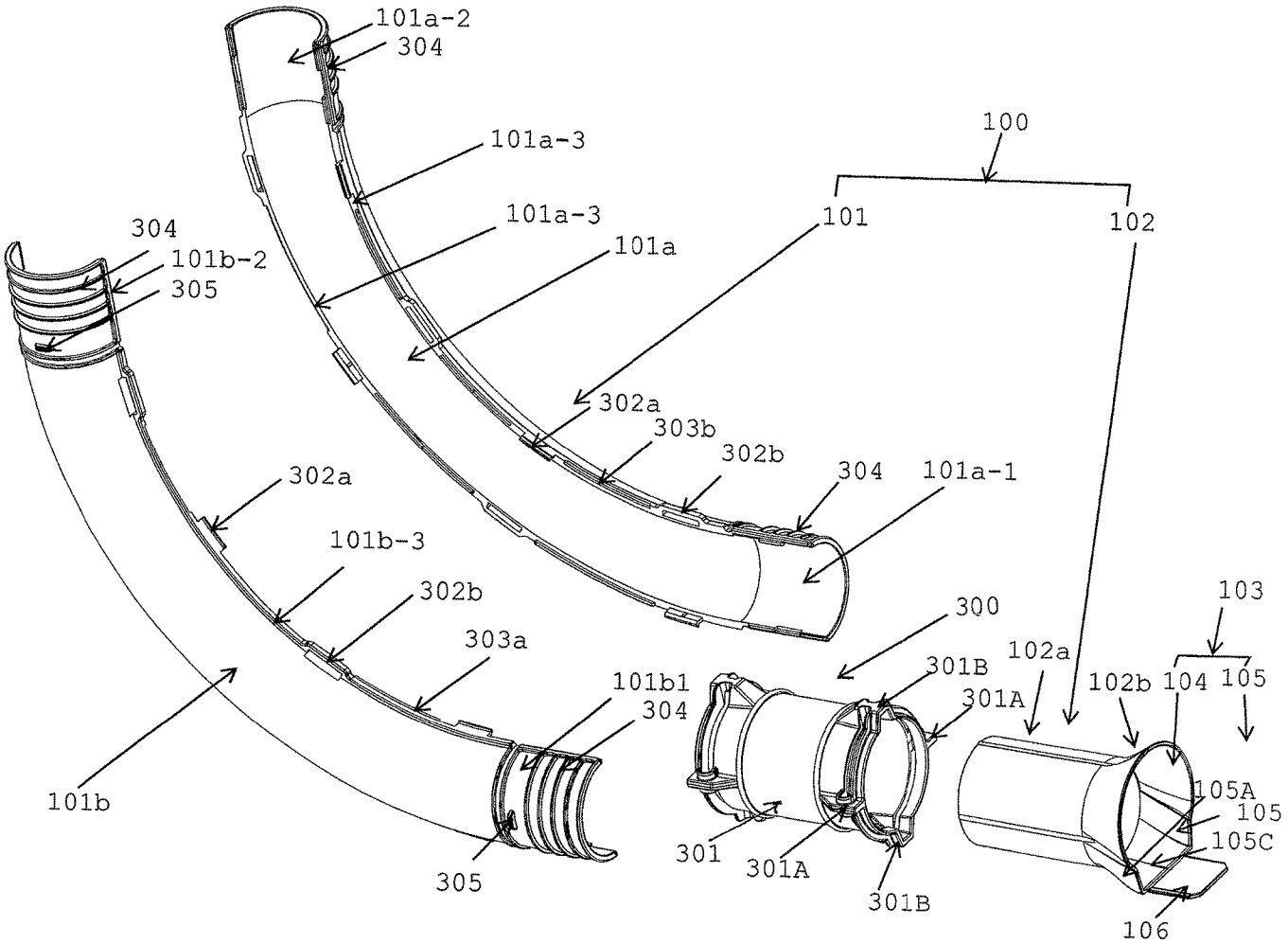
100
101
102
103
104
105
105A
105C
106
102a
102b
300
301
301A
301B
101a-1
101a
101a-2
101a-3
101b
101b1
101b-2
101b-3
302a
302b
303a
303b
304
305

TOY TRACK SYSTEM

The present invention relates to a toy track system for accommodating a toy vehicle moving therein, for example particularly, but not exclusively, a toy track system with changeable configuration.

BACKGROUND OF THE INVENTION

Toy track systems and toy vehicles are widely available. Track sections are provided for assembling into a fixed configuration. Commonly, the sections are open-top. The speed of the car is limited to avoid it from shooting off track. Tube-like sections are available but they are straight sections. Bent sections are made at very high cost. Furthermore, toy cars placed in a track system of tube-like sections are not reachable unless the track system is at least partially disassembled, creating access to the interior of the section. It is not possible to create an opening in the track system for inserting a car without affecting the car already running inside the track system.

For a section of the track system to be provided in the form of a tube, the tube material is generally resiliently deformable to form a bend when the two open ends are connected to other sections and are forced directly towards each other in different directions. The speed of the car running on resiliently deformable material is likely to be affected.

The invention seeks to eliminate or at least to mitigate such shortcomings for more fun by providing a new or otherwise improved toy track system and toy vehicle.

SUMMARY OF THE INVENTION

In a first aspect of the invention there is provided a toy track system comprising first and second sections together defining an interior for a toy car to move therein; and a connection module having coupling means which are provided along length at corresponding positions on the first and second sections and are inter-engageable with each other to prevent separation between the first and second sections, wherein the first and second sections each has a bend along length at corresponding positions between two ends pointing towards different directions and an arched periphery, the arch periphery of the first and second sections collectively forms a bent tube section; optionally, the coupling means are integrally formed with the first and second sections respectively; optionally, the coupling means and the respective first and second sections are simultaneously formed in a single step; optionally, the coupling means are evenly distributed along length at corresponding positions on the first and second sections; optionally the connection module further includes alignment means provided along length at corresponding positions on the first and second sections for proper relative positioning therebetween; optionally the coupling means and alignment means are arranged alternately along length at corresponding positions of the first and second sections respectively; optionally, the coupling means and alignment means are extensions provided on and along edges of the first and second sections; optionally, the connection module further includes coupling means provided at the two ends of the first and second sections for endwise connection with tube sections to form at least part of the toy track system; optionally the first and second sections are interchangeable by having identical structure.

In a second aspect of the invention, there is provided a toy track structure comprising first and second sections; and a connection module having coupling means for establishing endwise connection with the first and second sections respectively to prevent separation between the sections; wherein the second section comprises a guide provided on a free end of the second section for channeling an incoming toy car; optionally, the guide has a funnel portion with its larger end pointing away from the first section for channeling an incoming toy car; optionally, the funnel portion includes a frusto-conical section integrally formed with a receiving tray which is defined by a pair of slanted side walls connected to a flattened end surface on which the funnel portion sits; optionally, the flattened end surface has a tongue which extend therefrom for alignment of the toy car; optionally, the first and second sections are tube sections inter-connectable by the connection module to prevent axial separation between the tube sections; optionally, the first and second sections are interchangeable.

BRIEF DESCRIPTION OF DRAWING

The invention will now be more particularly described, by way of example only, with reference to the accompanying drawing, in which:

The FIGURE is an exploded view showing the toy track system and the toy track structure in accordance with the invention.

DETAILED DESCRIPTION OF PREFERRED EMBODIMENT

Referring to the FIGURE of the drawing, there is shown an embodiment of the invention encompassing a toy track system and a toy track structure 100.

The toy track system 100 includes first and second sections 101 and 102. These sections are tube-like. For easy reading, the first and second sections 101 and 102 are hereinafter named as the first and second tube sections 101 and 102.

These tube sections 101 and 102 are inter-connectable by a connection module 300 having coupling means for establishing endwise connection with the first and second tube sections 101 and 102 respectively to prevent axial separation between them. The coupling means includes a connection sleeve 301 into which the first and second tube sections 101 and 102 are insertable and remains inserted by way of frictional force between external peripheral walls of the tube sections 101, 102 and internal peripheral wall of the sleeve 301.

The sleeve 301 includes a number of seats 301A and 301B which supports the sleeve 301 on a surface. The seats 301B define an internal cavity into which a respective corresponding coupler 302*a* or 302*b* of the first tube section 101 is insertable. The sleeve 301 has symmetrical ends such that either tube sections 101 and 102 can be connected to either ends of the sleeve 301.

The tube section 101 is formed from two halves, namely the first and second sections 101*a* and 101*b*, hereinafter known as the first and second halves 101*a* and 101*b* for easy reading. Each of the first and second halves 101*a* and 101*b* includes a bend at corresponding positions along their lengths and between two ends which are pointing towards different directions such that the first and second halves 101*a* and 101*b*, when assembled, form a bent tube section.

The first and second halves 101*a* and 101*b* are formed by molding and are connectable to define a peripherally enclosed interior for a toy car to move therein. The two halves 101*a* and 101*b* are connectable by coupling means of the connection module which are provided along the lengths of the first and second halves 101*a* and 101*b* and are inter-engageable with each other to prevent separation between the first and second halves 101*a* and 101*b*. The coupling means is made up of hook and eye couplers 302*a* and 302*b* in an alternate arrangement.

With reference to the FIGURE, along the two edges 101*a*-3 of the first half 101*a* there are provided a plurality of hook and eye couplers 302*a* and 302*b* which are evenly distributed and arranged alternately along the length of each edge. Corresponding hook and eye couplers 302*a* and 302*b* are provided on the two edges 101*b*-3 of the second half 101*b* for coupling, more specifically, inter-engaging, with those on the first half 101*a* in a releasable manner.

The coupling means further includes alignment means. The alignment means is a pair of male and female members 303*a* and 303*b* which are co-operable to fix relative positioning between the two halves 101*a* and 101*b*.

The male and female members 303*a* and 303*b* are in pairs, one on each of the respective free edges 101*a*-3 and 101*b*-3 of the first and second halves 101*a* and 101*b*. In total, there are six pairs of male and female members 303*a* and 303*b*, evenly distributed on the outer and inner free edges 101*a*-3, 101*b*-3 of the first and second halves 101*a* and 101*b*, respectively. Each of the members 303*a* and 303*b* is arranged between a hook and an eye coupler 302*a* and 302*b*.

The second half 101*b* and the first half 101*a* are interchangeable and are basically are produced using the same mold.

Free ends of the first and second halves 101*a* and 101*b* include end portions 101*a*-1, 101*a*-2, 101*b*-1 and 101*b*-2.

Each of these end portions 101*a*-1, 101*a*-2, 101*b*-1 and 101*b*-2 is a short cylindrical tube with ribs 304 and a tongue 305 on its outer periphery. These ribs 304 form part of the coupling means of the connection module which is useful in establishing friction between the outer periphery of the end portions 101*a*-1, 101*a*-2, 101*b*-1 and 101*b*-2 and the inner periphery of the sleeve 301. The tongue 305, a coupling means, engages a corresponding recess (not shown) on the inner periphery of the sleeve 301. At each of the free edges 101*a*-3 of end portions 101*a*-1 and 101*a*-2 of the first half 101*a* there is one of a pair of male and female connectors. At corresponding positions on the free edges 101*b*-3 of the end portions 101*b*-1 and 101*b*-2, there are complementary connectors for connecting with those on the first half 101*a*.

The second tube section 102 includes a tube portion 102*a* and a guide 102*b*. The guide 102*b* includes a funnel portion 103 with its larger end pointing away from the tube portion 102*a* (and the first tube section 101 when connected) for channeling an incoming toy car into the tube portion 102*a*. The funnel portion 103 includes a frusto-conical section 104 that extends from and around part of the tube portion 102*a*, and a receiving tray 105 that extends from and around part of the tube portion 102*a*. The frusto-conical section 104 and the receiving tray 105 are integrally formed and, together, extend around all of the tube section 102*a*. The receiving tray 105 is defined by a pair of flat slanted side walls 105A and 105B connected to respective edges of a flattened end surface 105C, which extends between the slanted flat side walls 105A and 105B and on which the funnel portion 103 may sit. A tongue 106 extends from underneath the flattened end surface 105C for guiding an incoming toy car into the tube portion 102*a*.

The invention has been given by way of example only, and various other modifications of and/or alterations to the described embodiment may be made by persons skilled in the art without departing from the scope of the invention as specified in the appended claims.

The invention claimed is:

1. A toy track structure comprising:

a first tube section including a connection end and a free end, wherein the free end includes a guide having a funnel portion, with a larger end pointing away from the connection end of the first tube section, for channeling a toy car moving into the free end of the first tube section; and a connection module having coupling means for establishing endwise connection of the connection end of the first tube section to the connection module, wherein the funnel portion includes a frusto-conical section extending around part of the free end of the first tube section, and a receiving tray extending around part of the free end of the first tube section and joined to the frusto-conical section so that the frusto-conical section and the receiving tray extend around all of the free end of the first tube section, wherein the receiving tray includes two slanted flat side walls respectively joined to the frusto-conical section, a flattened end surface located between and joined to the two slanted flat side walls, and a tongue extending from underneath the flattened end surface, outwardly from the free end of the first tube section.

2. The toy track system as claimed in claim 1, further comprising second tube section having first and second ends and a length extending between the first and second ends, wherein the second tube section includes a bend along the length of the second tube section so that the first and second ends of the second tube section point towards different directions and the second tube section has an arched periphery, the second tube section includes first and second halves, the first and second halves, when joined together, define an interior volume through which the toy car can move, and the connection module includes longitudinal coupling means for engaging the first end of the second tube section, holding the first and second halves together and preventing separation of the first and second halves from each other.

3. The toy track system as claimed in claim 2, wherein the first and second halves include respective integral longitudinal elements that are complementary to and engage the longitudinal coupling means of the connection module when the first end of the second tube section is connected to the connection module.

4. The toy track system as claimed in claim 3, wherein the integral longitudinal elements and the respective first and second halves are simultaneously formed in a single step.

5. The toy track system as claimed in claim 1, wherein the first and second halves have respective lengths and respective edges along the lengths of the first and second halves, the first and second halves include transverse coupling means for coupling the first half to the second half, and the transverse coupling means includes transverse coupling elements that are evenly distributed along the lengths of the first and second halves at corresponding positions on the first and second halves.

6. The toy track system as claimed in claim 5, wherein the transverse coupling means includes alignment means located along the lengths of the first and second halves, at corresponding positions, for positioning of the first and second halves relative to each other, and transverse coupling elements located along the lengths of the first and second halves, at corresponding positions, for connecting the first half to the second half.

7. The toy track system as claimed in claim 6 wherein the transverse coupling elements and the alignment means are arranged alternately along the first and second halves.

8. The toy track system as claimed in claim 7, wherein the transverse coupling elements and the alignment means are extensions of and are located on and along the respective edges of the first and second halves.

9. The toy track system as claimed in claim 6, wherein the transverse coupling elements and the alignment means are extensions of and are located on and along the respective edges of the first and second halves.

10. The toy track system as claimed in claim 2, wherein the second tube section further includes circumferential elements at the first end, and the connection module includes circumferential coupling means for endwise connection of the connection module to the first end of the second tube section.

11. The toy track system as claimed in claim 1, wherein the first and second halves are interchangeable and have identical structures.

* * * * *